United States Patent [19]

Olsen

[11] 4,396,158

[45] Aug. 2, 1983

[54] DEVICE AND METHOD FOR PROCESSING HATCHERY OFFAL

[76] Inventor: Jerome A. Olsen, 2702 65th Dr., Franksville, Wis. 53126

[21] Appl. No.: 268,059

[22] Filed: May 28, 1981

[51] Int. Cl.[3] ..... B02C 4/02; B02C 4/30

[52] U.S. Cl. ..... 241/2; 241/224; 241/236

[58] Field of Search ..... 241/38, 236, 234, 2, 241/30, 222, 224, 285 B, 285 R, 285 A; 71/18, 15

[56] References Cited

U.S. PATENT DOCUMENTS

| | | | |
|---|---|---|---|
| 139,759 | 6/1873 | Bond | 71/15 |
| 1,681,920 | 8/1928 | Boccellieri | 241/236 |
| 2,434,938 | 1/1948 | Latture | 241/236 |
| 2,753,121 | 7/1956 | Elfenbein | 241/38 X |
| 3,841,465 | 10/1974 | Miller | 241/222 X |
| 4,073,444 | 2/1978 | Pav | 241/285 B X |

*Primary Examiner*—Mark Rosenbaum
*Assistant Examiner*—Timothy V. Eley
*Attorney, Agent, or Firm*—Michael, Best & Friedrich

[57] ABSTRACT

Offal from a poultry hatchery, including new-born chicks, is processed into a form suitable for rendering or disposal as land fill by dumping same into a device including a pair of elongated, generally cylindrical, counter-rotating rollers. Each roller has external longitudinally extending corrugations which mesh with the corrugations on the other roller. The corrugations are configured so that, as the offal passes between the counter-rotating rollers, new-born chicks and live, unhatched embryos are killed instantly and other debris, such as egg shells, are crushed into a smaller form.

5 Claims, 4 Drawing Figures

DEVICE AND METHOD FOR PROCESSING HATCHERY OFFAL

BACKGROUND OF THE INVENTION

This invention relates to a device and method for processing offal from a poultry hatchery into a form suitable for rendering or disposal as land fill.

Trays removed from the incubators of commercial poultry hatcheries contain new-born chicks, shells from hatched and partially hatched eggs, unhatched eggs and other debris. The new-born chicks are inspected for physical deformities and diseases. The malformed and diseased chicks, as well as the egg shells and the partially hatched and unhatched eggs, present special disposal problems. This hatchery offal will be accepted by rendering plants provided that it does not include live chicks. Government regulations and/or ordinances usually impose similar requirements before the offal can be disposed as land fill.

Some of the unhatched eggs may subsequently hatch. Consequently, in order to be in a form suitable for rendering or disposal as land fill, the hatchery offal must be processed in a manner to kill all the diseased and malformed chicks and also kill live, unhatched embryo. The processed offal often is transported from the hatchery in open truck beds. Therefore, the egg shells desirably should not be comminuted into small particle size which is subject to being blown about during handling and transportation.

Devices employing a large relatively centrifuge has been used to process hatchery offal. These devices pulverize the offal into a size suitable for disposal in sewers. However, in addition to requiring relatively large motors (e.g., up to 25 horsepower) with the attendant electrical energy requirements, these devices usually require relatively large volumes of water, for example, 350–700 gallons per hour. This amount of water, if a supply is available, may exceed the sewer capacity for the hatchery in some cases.

SUMMARY OF THE INVENTION

One of the principal objects of the invention is to provide a simple, low cost method and device for effectively processing offal from a poultry hatchery into a form suitable for rendering or disposal as land fill.

Another of the principal objects of the invention is to provide such a method and device which requires a minimum amount of water and electrical energy.

Other objects, aspects and advantages of the invention would become apparent for those skilled in the art upon reviewing the following description, the drawings and the appended claims.

The device provided by the invention includes a housing, a pair of elongated, generally cylindrical, counter-rotating rollers rotatably mounted in the housing with the axes in parallel, side-by-side relation, and means for counter-rotating the rollers. The outer periphery of each roller has a plurality of longitudinally extending corrugations which are circumferentially spaced at uniform intervals and mesh with, but do not contact, the corrugations of the other roller. The device also includes a hopper which is located above the housing and into which offal from a poultry hatchery, including new-born chicks, is dumped. The hopper guides the offal into the nip between the rollers and the offal is passed beteen the counter-rotating rollers to instantly kill the new-born chicks and to crush the other debris into a smaller form.

The peaks and valleys of the roller corrugations preferably are configured so that the body of a new-born chick can fit into the space between the valley of a corrugation on one roller and the peak of a corrugation on the other roller. The clearance between the meshing corrugations is sufficient to prevent jamming and yet close enough to instantly kill new-born chicks and live, unhatched embryo as the offal passes between the rollers.

DESCRIPTION OF THE PREFERRED EMBODIMENTS

Figures 1, 2:
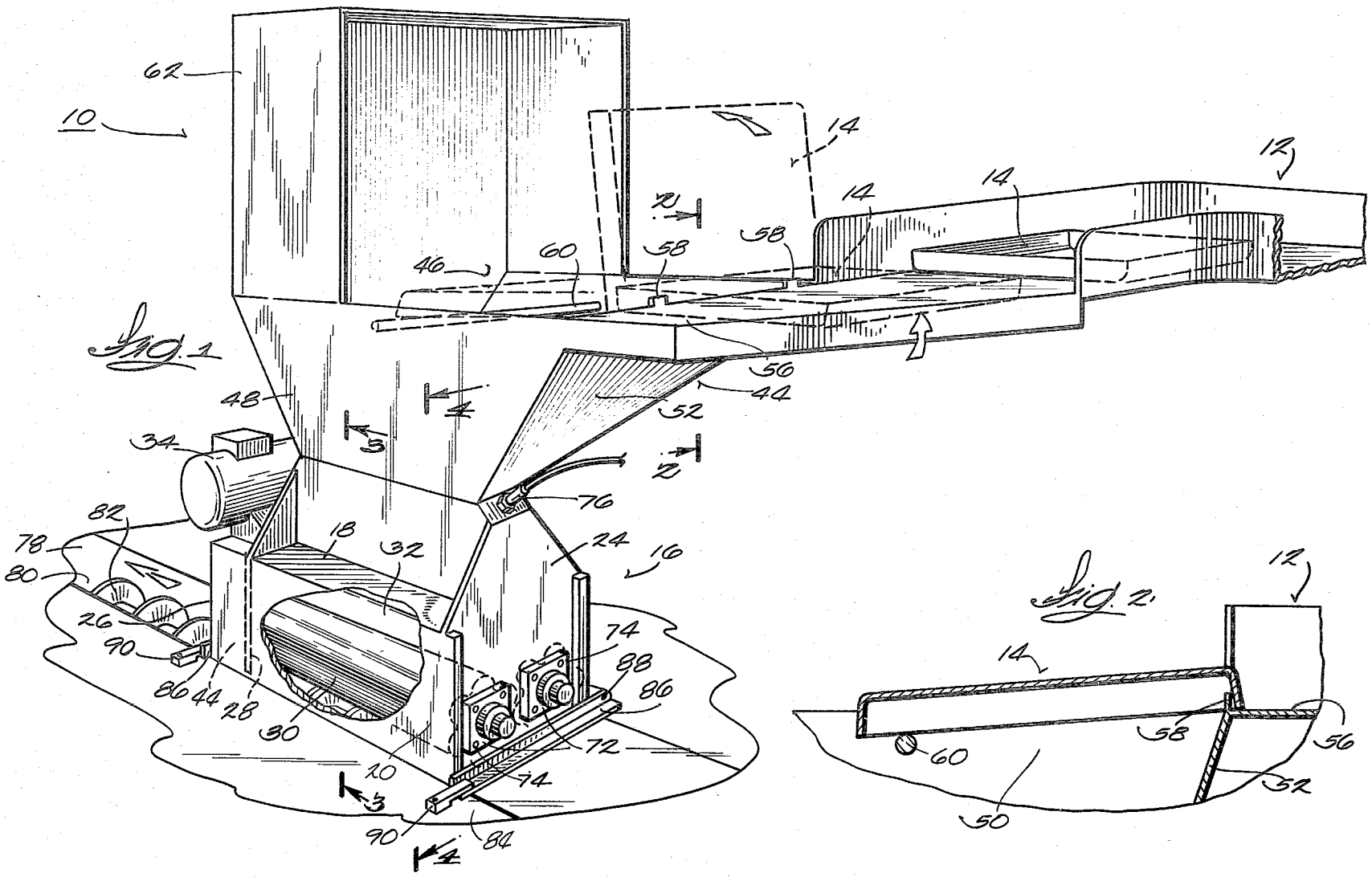
FIG. 1 is a perspective, partially broken away, view of a device embodying the invention, shown located adjacent the end of an inspection line for trays from a poultry incubator.
FIG. 2 is a sectional view taken generally along line 2—2 in FIG. 1.
Figure 4:
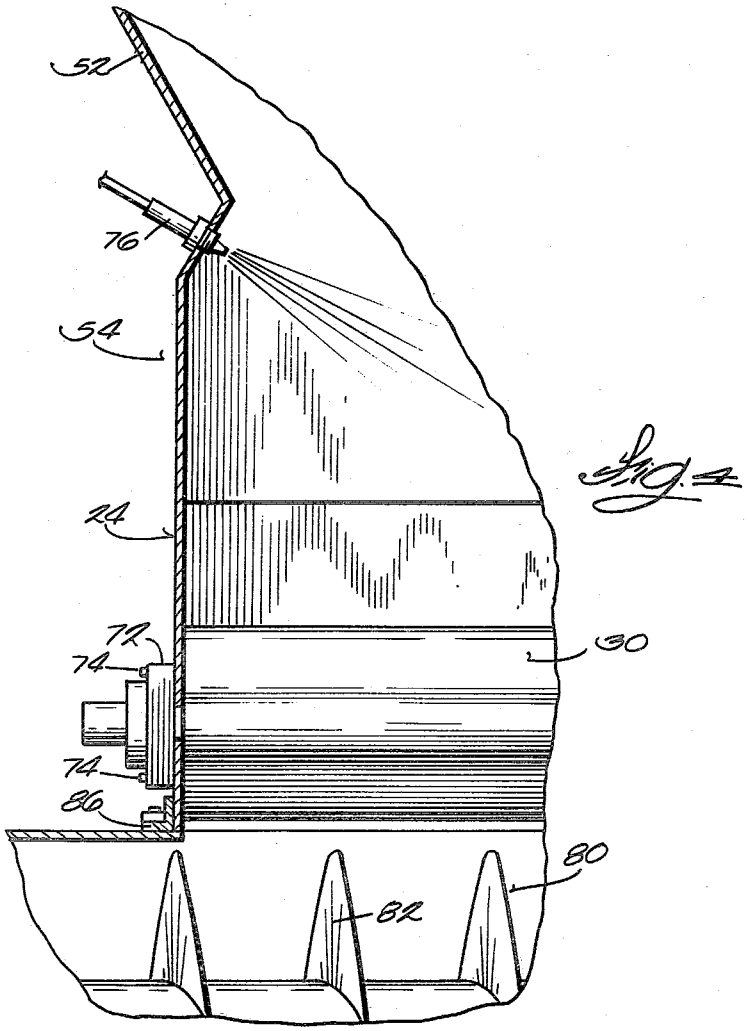
FIG. 4 is a sectional view taken generally along line 4—4 in FIG. 1.

Illustrated in FIG. 1 is a device 10 which is particularly adaptable for use in processing offal from a poultry (e.g., chickens, turkeys, ducks, geese, etc.) incubator into a form suitable for rendering or disposal as land fill.

The device 10 is located adjacent the end of an inspection line 12 for trays 14 from an incubator (not shown). Each incubator tray 14 contains new-born chicks, shells from unhatched eggs and partially hatched eggs, unhatched eggs and other debris (not shown). As a tray 14 moves along the inspection line, the new-born chicks are inspected for physical deformities and diseases. The healthy chicks are removed and those which are physically deformed or diseased are left in the tray 14 and dumped therefrom into the device 10 for processing, along with the shells from hatched eggs partially hatched and unhatched eggs and other debris.

The device 10 includes a lower housing 16 having a top wall 18, side walls 20 and 22, a front wall 24, a rear wall 26, a partition 28 spaced inwardly from the rear wall 26, and an open bottom 29. Disposed inside the lower housing 16 is a pair of elongated, generally cylindrical, counter-rotating rollers 30 and 32. The opposite ends of the rollers 30 and 32 are suitably journalled in the end wall 24 and the partition 28 with their axes in parallel, side-by-side relation. The rollers 30 and 32 are driven by a small, variable speed electrical motor 34 (e.g., ½ horsepower) mounted on the housing top wall 18.

The motor 34 drives the rollers 30 and 32 through a suitable drive train including a conventional slip clutch operative to prevent rotation of the rollers in the event a large foreign objects such as a stick of wood, a wrench or the like, accidentally falls between the rollers or an operator inadvertently sticks his hand between the rollers. In the specific construction illustrated, large gears 36 and 38 are connected to one end of the rollers 30 and 32, respectively. Meshing with the large gear 36 is an idler gear 40 which meshes with and is driven by a drive gear 42 which in turn meshes with the large gear 38 and is drivingly connected to the motor via a drive chain and a slip clutch (not shown). The gears 36, 38, 40 and 42 are located within a compartment 44 defined between the end wall 26 and the partition 28.

Located above the lower housing 16 is a hopper 44 including a generally vertical rear wall 46 and converging side and front walls 48, 50 and 52. The hopper 44 also includes chute 54 having a pair downwardly diverging walls 55 forming an inverted funnel for directing the offal into the nip between the rollers 30 and 32. The diverging walls 55 substantially eliminate any "bridging" or plugging of the chute by the moist offal.

Extending generally horizontally from the top edge of the hopper wall 52 is a ledge or platform 56 for supporting a tray 14 containing hatchery offal. A tray 14 is dumped by sliding one edge against a pair of upwardly projecting stops 58 located on the inner edge of the platform 56 and tipping the tray 14 over, as illustrated in FIG. 1, until it falls against a tip bar 60 extending laterally between hopper walls 48 and 50. A hood 62 extending upwardly from the rear portion of the hopper rear wall 46 and side walls 48 and 50 prevents hatchery offal, dumped from the tray during the tipping operation, from falling onto the floor.

The outer periphery of each roller 30 and 32 (FIG. 3) has a plurality of longitudinally extending corrugations 62 which are circumferentially spaced at uniform intervals and mesh with, but do not contact, the corrugations 64 on the other roller. The hatchery offal is crushed or smashed as it passes between the counter-rotating rollers 30 and 32. Most of the shells of the hatched eggs are comminuted into a smaller size and/or flattened. The unhatched eggs are crushed and the shells are comminuted and/or flattened. The unhatched embryo and the malformed and diseased new-born chicks are crushed and killed instantly.

Figure 3:
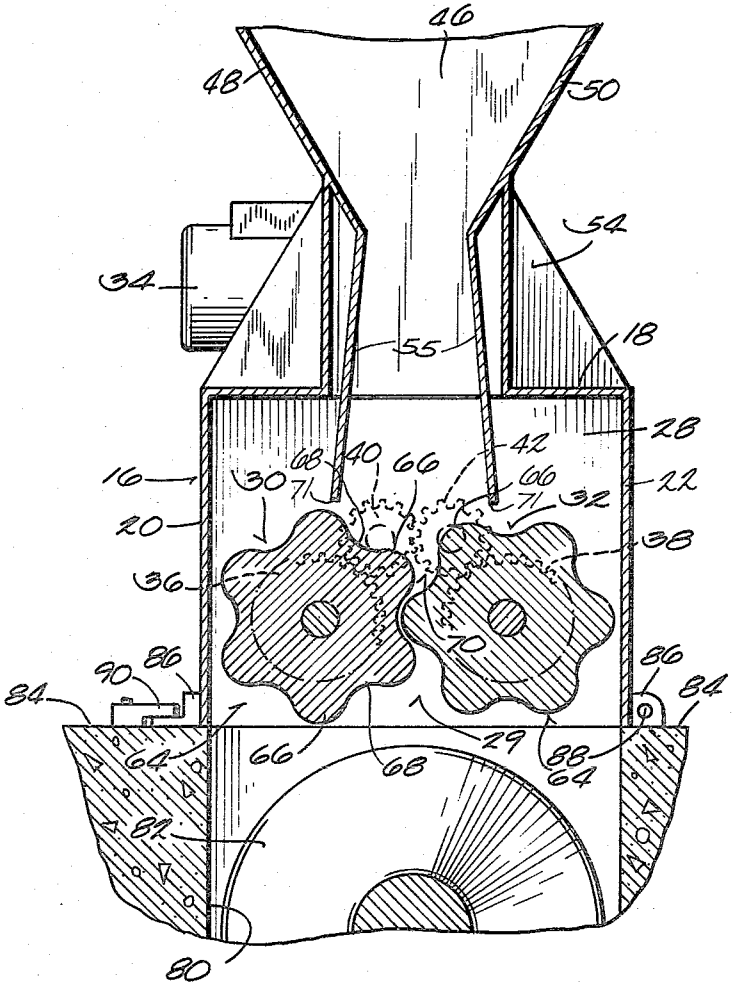
FIG. 3 is a sectional view taken generally along line 3—3 in FIG. 1.

The peaks 66 and valleys 68 of the roller corrugations 64 preferably are configured so that the body of a new-born chick can fit in the space, designated by reference numeral 70 in FIG. 3, between a valley 68 on one roller and a peak 66 on the other roller just prior to meshing. This insures that a chick falling through the chute 54 will pass directly and completely between the rollers 30 and 32 and be killed instantly.

For best results, the clearance between the roller corrugations 64 should be sufficient to prevent jamming and yet close enough to insure that the chicks are rapidly crushed in a manner to kill them instantly. As a guide, for rollers having six lobes or peaks and a pitch diameter of about $7\frac{1}{4}$ inches, a clearance of about $\frac{1}{4}$ inch is adequate. Clearances less than about $\frac{1}{8}$ inch tend to cause jamming when large volumes of offal are being processed and clearances larger than $\frac{3}{8}$ inch do not provide adequate crushing to insure instant killing of all chicks.

Means can be provided for mounting the rollers 30 and 32 on the lower housing 16 so that the clearance between the rollers 30 and 32 can be adjusted. While various suitable means can be used, in specific construction illustrated, each of the rollers 30 and 32 is journalled in a pair of bearing retainers 72 (one shown in FIG. 1 for each roller) and the front wall 24 and the partition 28 are provided with horizontally extending slots (not shown) for receiving mounting bolts 74.

The rollers 30 and 32 are counterrotated at a speed high enough to prevent binding and to insure instant killing of the chicks, but slow enough to minimize noise. Generally a speed of 12 to 18 RPM is adequate.

The chute walls 55 terminate in a lower edge 71 located close to the travel path of roller peaks 66 and inwardly from the centerline of the respective roller to insure that substantially all of the offal passes into the nip between the rollers 30 and 32 instead of falling over the outside of the rollers.

Mounted on the front and rear walls of the chute 54 is a pair of spray nozzles 76 (one shown) which direct a small flow of water onto the surface of the rollers 30 and 32 shortly before they mesh for the purpose of keeping them clean. A flow of water in order of about 0.5 gallons per minute usually is adequate for this purpose.

The processed offal and water exiting from the rollers 30 and 32 drops through the open bottom 29 of the lower housing 16 into an auger conveyor 78 or other suitable conveying means which conveys it to a truck or the like for transporting to a rendering plant for processing or to a land fill for disposal. The illustrated auger conveyor 78 includes a pit 80 in the floor 84 and an auger 82 which moves the processed offal and water through the pit 80 to a discharge point. The pit 80 is usually covered by a removable grating or plate (not shown).

To facilitate cleaning, maintenance and/or replacement of the rollers 30 and 32, the device preferably is pivotally mounted on the floor 84 so it can be tipped over in a manner whereby the rollers 30 and 32 are accessible through the open bottom 29 of the lower housing 16. In the specific construction illustrated, the lower housing 16 is supported on the floor 84 by a pair of angle irons 86 which are affixed on the bottom portion of the front wall 24 and the rear wall 26 and span the conveyor pit 80. One end of each angle iron 86 is rotatably mounted via a pin or bar 88 carried by a fixture (not shown) affixed on the floor 84. The other end of each angle iron 86 is held in place by a strap 90 which is pivotally fastened on the floor 84 so it can be pivoted away from the angle iron to permit the device to be tipped relative to the floor in the clockwise direction as viewed in FIG. 1.

From the above description, it can be seen that the device and method provided by the invention are capable of effectively processing poultry offal into a form suitable for a rendering plant or disposal as land fill with minimal amounts of energy and water. Live new-born chicks and unborn embryo are instantly killed in a humane manner and the egg shells are not comminuted into a fine particle size tending to cause dusting or blowing problems during handling or transporting.

From the above description, one skilled in the art can easily ascertain the essential features of the invention and, without departing from the scope and spirit thereof, can make various changes and modifications to adapt the invention to various usages and conditions.

I claim:

1. A method for processing offal from a poultry hatchery, including new-born chicks, into a form suitable for rendering or disposal as land fill comprising the steps of providing a pair of elongated, generally cylindrical rollers, each roller having an outer periphery including a plurality of longitudinally-extending corrugations which are circumferentially spaced at uniform intervals and mesh with, but do not contact corrugations on the other roller as the rollers are counter-rotated, the corrugations having peaks and valleys which are configured so that the body of a new-born chick can fit into the space between the valley of a corrugation on one roller and the peak of a corrugation on the other roller just prior to meshing, counter-rotating the rollers, introducing the offal into the nip between the rollers, passing the offal between the rollers to instantly kill the new-born chicks therein and to crush other debris into smaller form, and discharging the processed offal from the rollers into a means for conveying same to a remote location.

2. A method according to claim 1 wherein said rollers are rotated at about 12 to about 18 rpm.

3. A method according to claim 1 wherein the clearance between the meshing corrugations of the rollers is sufficient to prevent jamming and yet close enough to instantly kill new-born chicks.

4. A method according to claim 1 including directing a liquid spray onto the surface of the rollers shortly before they mesh.

5. A method according to claim 1 including providing a hopper including a chute having a pair of downwardly diverging walls for guiding the offal into the nip between the rollers, each of these walls terminating in a lower edge located close to the travel path of the peaks and inwardly from the center line of the respective roller.

* * * * *